United States Patent [19]

Hirsch et al.

[11] Patent Number: 4,777,478

[45] Date of Patent: Oct. 11, 1988

[54] APPARATUS FOR MONITORING PERSONS OR THE LIKE

[75] Inventors: Gordon S. Hirsch; Marilyn F. Hirsch, both of 4638A Dobson Dr., Skokie, Ill. 60077; Paul W. Hansen, Downers Grove, Ill.

[73] Assignees: Gordon S. Hirsch; Marilyn F. Hirsch, both of Skokie, Ill.

[21] Appl. No.: 46,393

[22] Filed: May 6, 1987

[51] Int. Cl.[4] ..... G08B 19/00; G08B 25/00

[52] U.S. Cl. ..... 340/573; 340/521; 340/539; 340/568; 379/38

[58] Field of Search ..... 340/539, 517, 521, 568, 340/573, 693, 691; 379/38

[56] References Cited

U.S. PATENT DOCUMENTS

| | | | |
|---|---|---|---|
| 3,336,530 | 8/1967 | Sloan | 325/29 |
| 3,810,146 | 5/1974 | Lieb | 340/279 |
| 4,121,160 | 10/1978 | Cataldo | 340/321 |
| 4,136,338 | 1/1979 | Antenore | 340/551 |
| 4,157,540 | 6/1979 | Oros | 340/539 |
| 4,300,129 | 11/1981 | Cataldo | 340/539 |
| 4,336,531 | 6/1982 | Kincaid | 340/568 |
| 4,347,501 | 8/1982 | Akerberg | 340/573 X |
| 4,399,432 | 8/1983 | Lunn | 340/573 |
| 4,468,656 | 8/1984 | Clifford et al. | 340/573 X |
| 4,549,169 | 10/1985 | Moura et al. | 340/539 |
| 4,593,273 | 6/1986 | Narcisse | 340/539 |
| 4,598,272 | 7/1986 | Cox | 340/539 |
| 4,665,385 | 5/1987 | Henderson | 340/573 X |

*Primary Examiner*—Glen R. Swann, III

*Attorney, Agent, or Firm*—Shlesinger Arkwright & Garvey

[57] ABSTRACT

The present invention discloses an apparatus for monitoring persons, pets, things and the like including a monitored unit and a monitoring unit each having a transmitter and receiver. The monitored unit is adapted to transmit a periodic signal while the activities of the monitored object coincide with various threshold conditions. The monitored unit includes a plurality of indicators either visual or audio which inform the operator that the monitored unit has exceeded various threshold conditions. The monitoring unit includes a reset transmitter for actuating the monitored unit so that it produces either a continuous signal or a periodic signal. The monitoring unit further includes a homing mechanism automatically actuated upon receipt of either a continuous signal or an alarm signal by its receiver. The monitored unit includes a plurality of sensing switches for informing the operator of the monitoring unit that either the monitored object has energized a manual actuation alarm, someone has tired to remove the monitored unit from the monitored object or the monitored unit has been immersed in water.

18 Claims, 3 Drawing Sheets

APPARATUS FOR MONITORING PERSONS OR THE LIKE

FIELD OF THE INVENTION

This invention relates to an apparatus for monitoring persons, pets, things or the like. Specifically, an apparatus capable of informing an operator that the activities of the object being monitored have exceeded various threshold conditions.

BACKGROUND OF THE INVENTION

Numerous devices have been developed to monitor the activities of individuals in lieu of the growing concern of children being abducted from their parents. The need for monitoring devices, in this particular application, has arisen due to the fact that a parent cannot watch his child every minute of every day and still go about doing their daily tasks. Additionally, monitoring apparatuses have been employed to monitor the whereabouts of valuable cargo. Further, these devices have been implemented in mental and correctional institutions where the need for monitoring inmates is great due to the disproportional ratio of inmates to institutional staff members. The following U.S. Pat. Nos. disclose various devices for monitoring persons and the like: 3,336,530 Sloan et al; 3,810,146 Lieb; 4,121,160 Cataldo; 4,136,338 Antenore; 4,157,540 Oros; 4,300,129 Cataldo; 4,336,531 Kincaid; 4,399,432 Lunn; 4,593,273 Narcisse; 4,598,272 Cox. The monitoring apparatuses disclosed in the aforementioned patents fall into two general categories. The first category being devices that only transmit a signal between the monitoring and monitored units when an individual activates the device. These types of monitoring apparatuses are very limited in their applications. The second major category of monitoring apparatuses are those which provide a continuous signal between the monitored and monitoring units. These types of monitoring devices have been designed to only inform an operator that an alarm condition is present and are unable to inform the operator of the specific activities of the object which resulted in the alarm condition. By providing only a single alarm to inform the operator that a threshold condition has been exceeded, these monitoring devices do not in any way limit the possibilities which may have given rise to the alarm conditions. Therefore, the parent or operator must consider all possibilities as opposed to focusing on only a few specific possibilities. This deficiency in the known monitoring apparatuses significantly reduce the likelihood that the parent/operator will be able to locate the monitored person or thing before it is to late. Further, the continuous signal type monitoring apparatuses significantly drain the power supply of the unit sending the signal. Thus, the batteries or the like are required to be replaced frequently. Additionally, the aforementioned monitoring apparatuses are unable to readily locate the monitored person or thing once an alarm condition has been triggered. Therefore, eventhough the operator is informed that an alarm condition is present, he is given no clue as to the direction to proceed in order to find the monitored object.

Prior to the present invention, monitoring apparatuses have not been able to monitor the specific activities of an object without significantly draining the power supply of the apparatus. Additionally, the prior art has been unable to inform the operator as to the specific activity of the monitored person which led to the alert condition or conditions. Finally, the aforementioned apparatuses have been unable to provide an efficient method for locating the monitored individual or the like once an alarm condition has surfaced.

OBJECTS AND SUMMARY OF THE INVENTION

Accordingly, it is an object of this invention to provide an improved apparatus for monitoring persons, pets, things or the like.

Another object of the invention is to provide a monitoring apparatus of the continuous type which significantly reduces the drain on the power supply.

A further object of the invention is to provide an apparatus for monitoring persons, pets, things or the like that will enable the operator to readily locate the monitored object once an alarm condition has been triggered.

Yet another object of the invention is to provide a monitoring apparatus capable of monitoring a plurality of activities of the monitored person including the relative distance of the monitored person from the monitoring unit, whether the monitored unit is still transmitting a signal, whether the monitored unit has been removed from the object being monitored, whether the object being monitored has been submersed into water, and whether the monitored person has manually activated an alarm.

Another object of the invention is to provide a miniaturized monitored unit in order that the monitored unit can be readily concealed on the monitored object.

Another object of the invention is to provide a monitoring apparatus with a directional locator or homing device that is automatically activted upon receipt of an alarm signal or a continuous signal.

A further object of the invention is to provide a monitoring apparatus that will transmit an alarm signal under various conditions and will maintain the alarm signal even though the condition is no longer present until deliberately reset by the operator of the monitoring unit.

Yet another object of the invention is to provide a monitoring apparatus for transmitting a periodic signal while threshold conditions are present for prolonging the life of the power supply.

In summary, the present invention discloses a novel apparatus for monitoring persons, pets, things and the like that significantly reduces the drain on the power supply of the monitoring apparatus, informs the operator of the specific activity leading to the alarm condition, and provides an efficient and effective method for locating the monitored object once the alarm condition has been triggered.

DETAILED DESCRIPTION OF THE INVENTION

FIGS. 1 through 4

Figure 1:
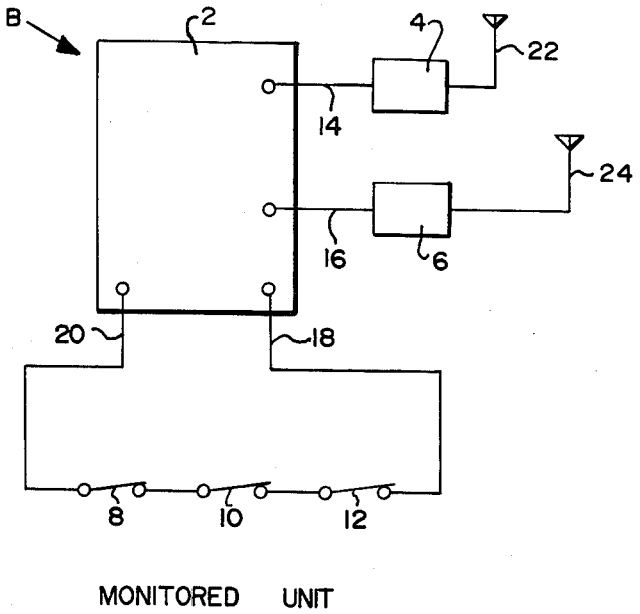
FIG. 1 is a block diagram of the monitored unit formed in accordance with the present invention.

The monitoring apparatus A formed in accordance with the present invention includes a monitored unit B and a monitoring unit C. The monitored unit B is placed on the object to be monitored and the monitoring unit C is to be worn by the operator/individual monitoring the activities of the monitored object.

The monitored unit B includes a digital logic board 2, a transmitter 4, a receiver 6, and three sensing switches 8, 10, and 12. The transmitter 4, receiver 6, and switches 8, 10, and 12 are electrically connected to digital logic board 2 by lines 14, 16, 18 and 20 respectively. Antennas 22 and 24 are operably associated with transmitter 4 and receiver 6 respectively.

Figure 3:
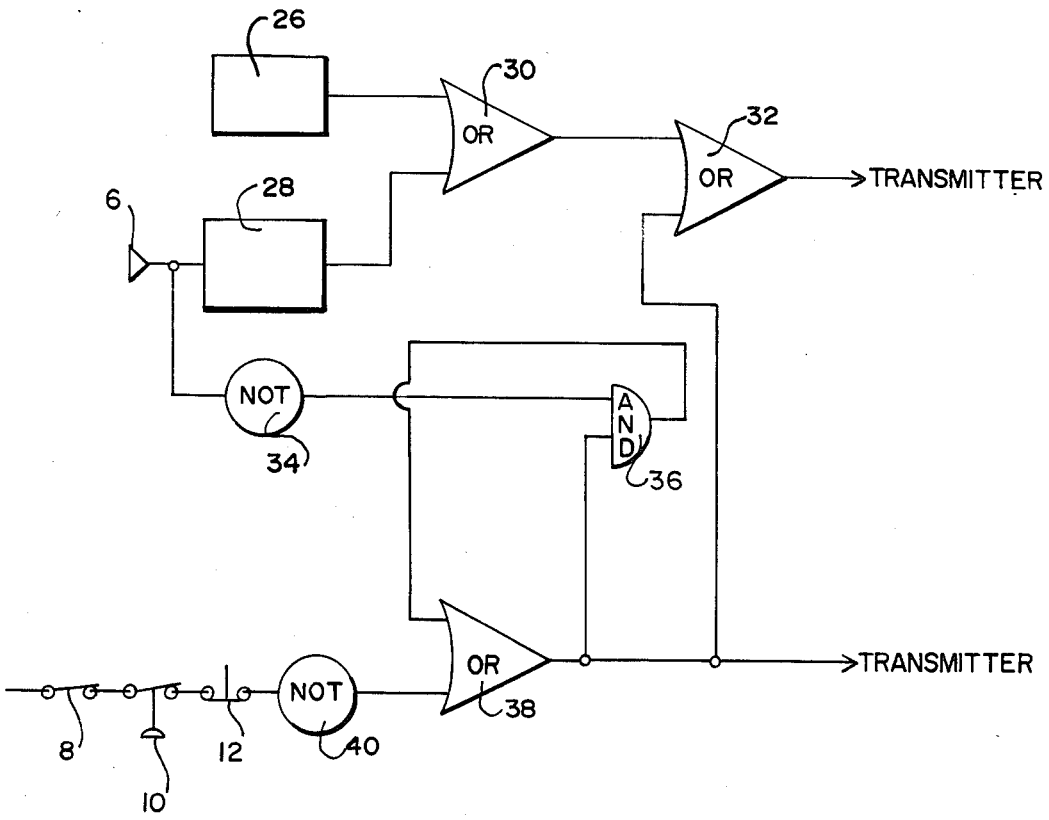
FIG. 3 is a schematic of the specific circuitry of the monitored unit.

Referring to FIG. 3, the specifics of the digital logic board 2 will be hereinafter described. The digital logic board 2 consists of a cycle timer 26 and a bistable multivibrator 28. The output of the cycle timer 26 is operably connected to a first input of OR logic gate 30. The output of bistable multivibrator 28 is operably connected to the second input of OR gate 30. The output of OR gate 30 is directed to a first input of OR gate 32. The output of OR gate 32 is connected to transmitter 4. The cycle timer 26 generates a periodic signal. A preferable cycle time for the cycle timer 26 which drives the carrier signal is one second of signal broadcast and fifteen seconds of quiescent or no signal broadcast.

The bistable multivibrator 28 generates a low and high output depending upon the activation of the reset signal by the operator of the monitoring unit. During normal operation, i.e., no alarm/alert condition is present, the bistable multivibrator 28 generates a low output. In this state, the output of the OR gate 30 will track the periodic output of the cycle timer 26. Therefore, the OR gate will have an output signal transmitted to OR gate 32 one second out of every sixteen seconds. It will be obvious to one of ordinary skill in the art to vary the cycle time of the unmodulated carrier signal produced by the cycle timer 26 to meet the specific needs of the user. The monitoring unit C is adapted to reset the bistable multivibrator such that it produces a continuous high output. The specifics of the activating mechanism of the monitoring unit C will be discussed more fully below. While the bistable multivibrator is producing a continuous high output, the output of OR gate 30 will be continuous resulting in OR gate 32 producing a continuous output. Thus, transmitter 4 will transmit a continuous unmodulated carrier signal to the monitoring unit C.

The input of bistable multivibrator 28 is operably connected to the receiver 6. Also, the input of NOT gate 34 is operably connected to receiver 6 and is in parallel with bistable multivibrator 28. The output of NOT gate 34 is directed to a first input of AND gate 36. The output of AND gate 36 is electrically connected to a first input of OR gate 38. The output of OR gate 38 is connected to the second input of AND gate 36, the second input of OR gate 32, and the transmitter 4. A high output from OR gate 38 activates the modulation circuitry of the transmitter 4 for an alarm signal. The output of NOT gate 40 is connected to the second input of OR gate 38. Sensing switches 8, 10, and 12 connected in series are electrically connected to the input of NOT gate 40. Sensing switches 8, 10 and 12 are connected in series. The cycle timer 26, bistable multivibrator 28, and switches 8, 10, and 12 are connected to a power source, not shown.

Figure 2:
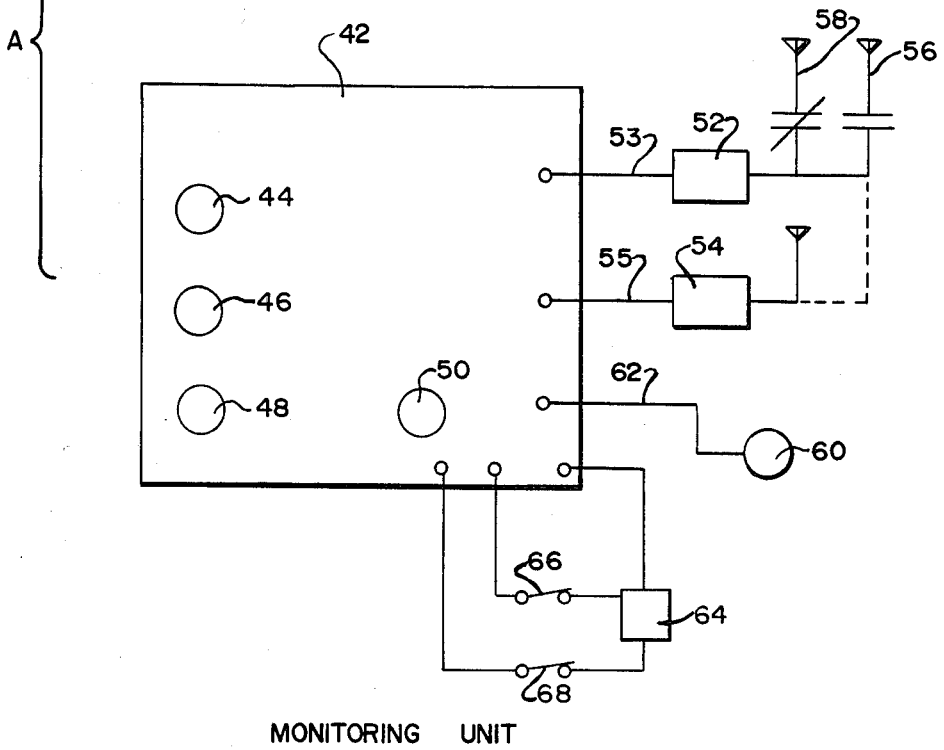
FIG. 2 is a block diagram of the monitoring unit formed in accordance with the present invention.

Referring to FIG. 2, the specifics of the monitoring unit C will be hereinafter described. The monitoring unit C includes a digital logic board 42 including visual indicators 44, 46, 48, and 50. It will be readily appreciated that monitored unit B could be provided with equivalent indicating mechanisms. A receiver 52 and a transmitter 54 are electrically connected to digital logic board 42 via lines 53 and 55 respectively. Receiver 52 includes a unidirectional antenna 56 and a directional antenna 58. Unidirectional antenna 56 is adaptable to be operably connected to transmitter 54. A directional meter 60 is connected to digital logic board 42 via line 62. Buzzer or audio alarm 64 is connected to digital logic board 42. Buzzer 64 includes deactivation switches 66 and 68.

Figure 4:
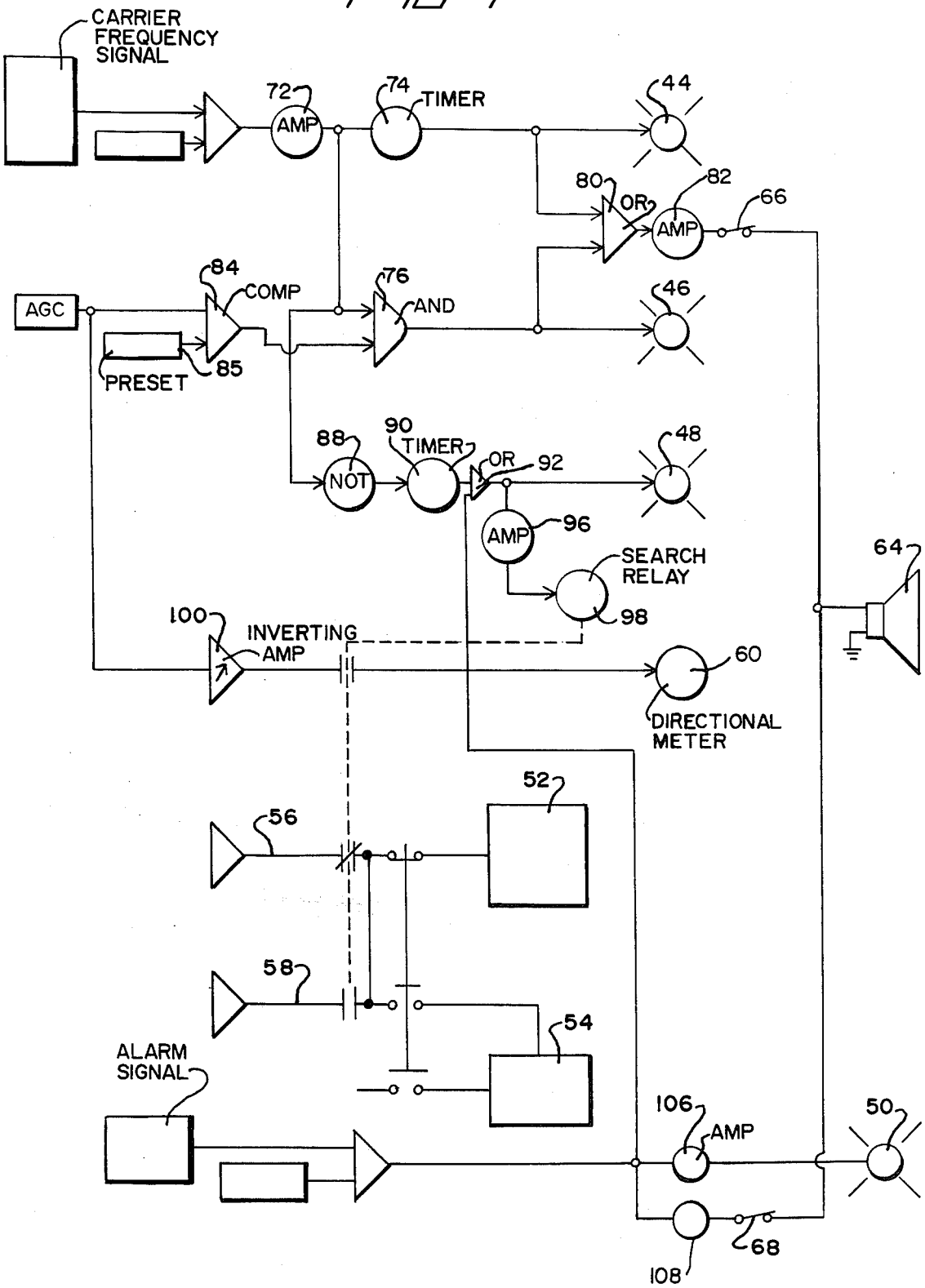
FIG. 4 is a schematic view of the circuitry of the monitoring unit.

Referring to FIG. 4, the specifics of the digital logic board 42 will be hereinafter described. Amplifier 72 is operably connected to receiver 52. The receiver 52 directs the unmodulated carrier signals, periodic and continuous, through amplifier 72. The output of amplifier 72 is connected to the input of timer 74 and a first input of AND gate 76. The output from timer 74 is connected to indicator 44 and a first input of OR gate 80. Indicator 44 informs the operator/attendant that the monitored unit is no longer transmitting a signal. The output of OR gate 80 is directed through amplifier 82.

Comparator 84 is operably connected to receiver 52 and compares the automatic gain control signal with a preset mechanism 85. The value of the preset mechanism 85 can be adjusted through a variable resistor. The output of comparator 84 is connected to the second input of AND gate 76. The output of AND gate 76 is connected to indicator 46. Indicator 46 informs the attendant/operator that monitored unit B has exceeded a predetermined distance range relative to the monitoring unit C.

The output of amplifier 72 is further directed to the input of NOT gate 88. The output of NOT gate 88 in turn is connected to the input of timer 90. The output of timer 90 is directed to the first input of OR gate 92. The output of OR gate 92 is in turn connected to indicator 48 and amplifier 96. Indicator 48 informs the operator/attendant that the monitoring unit C is in the search mode. The output of amplifier 96 is connected to search relay 98. Inverting amplifier 100 is operably associated with receiver 52 in order to amplify the automatic gain control signal. The output of inverting amplifier 100 is directed to directional meter 60.

Amplifier 106 is operably associated with receiver 52. Receiver 52 directs the modulated alarm signal transmitted by monitored unit B to amplifier 106. Amplifier 106 amplifies the modulated signal and directs it to indicator 50. The outputs of amplifiers 82, 106 and 108 are linked to audio alarm 64. Switches 66 and 68 enable the operator to deactivate audio alarm 64.

OPERATION

The operation of the monitoring apparatus A of the present invention will be hereinafter discussed. The monitoring apparatus A operates under three basic modes including a normal operation mode, an alarm/alert condition mode, and a search mode.

During normal operation of the monitoring apparatus A, the cycle timer 26 of the monitored unit B produces a periodic carrier signal and the bistable multivibrator 28 produces a low output. Additionally, in the normal operation mode switches 8, 10, and 12 are closed thereby delivering a high output signal to NOT gate 40 which in turn will generate a low output to OR gate 38 resulting in a zero output therefrom. Thus, the transmitter 4 will transmit a periodic signal of the type produced by cycle timer 26. The periodic signal will be received by the monitoring unit C via receiver 52. Receiver 52 directs the periodic carrier signal to amplifier 72. The amplified periodic signal is then directed to timer 74. It will be obvious to one of ordinary skill in the art to vary the time period of the timer 74 to accommodate various needs of an individual. In the preferred embodiment timer 74 has a twenty second time interval. If a periodic signal is received within twenty seconds, the timer 74 is reset. As previously stated, the monitored unit B transmits a periodic carrier signal at least every sixteen seconds. Thus, timer 74 will be continuously reset as long as monitoring unit C receives the periodic carrier signal. Thus, timer 74 produces a zero output and loss of signal indicator 44 remains unlit.

The output of amplifier 72 is further directed to NOT gate 88. The output of NOT gate 88 is directed to a five second timer 90. Timer 90 measures the length of the carrier signal produced by monitored unit B. During the time interval where no unmodulated carrier signal is being transmitted NOT gate 88 receives a low input and in turn provides a high output. The timer 90 is designed to activate upon receipt of a low output. Thus, while no carrier signal is produced, timer 90 is dormant. Upon receipt of the periodic modulated signal transmitted by monitored unit B, NOT gate 88 generates a low output and thus triggers timer 90. During normal operation, the timer 90 will reset before timing out since the periodic signal is only transmitted for a period of one second.

During normal operation, the automatic gain control signal will be greater than or equal to the preset signal and thus result in zero or minimum output from comparator 84. Although the output from amplifier 72 directed to a first input of AND gate 76 is high, the second input of AND gate 76 from the output of comparator 84 is low and will ensure that the child too far indicator 46 remains unlit.

Finally, amplifier 106, during normal operation, will receive a zero input resulting in no output. Therefore, alarm indicator 50 will remain unlit.

The monitoring unit C monitors the object wearing the monitored unit B to determine whether several alert/alarm conditions are present. These alert/alarm conditions include a first condition where the object has travelled beyond a predetermined distance, a second condition where the monitoring unit is no longer receiving a signal from the monitored unit B, a third condition where the monitored object has been immersed in water, a fourth condition where the monitored unit B has been removed from the object, and a fifth and final condition where the object manually activates an alarm.

The operation of the monitoring apparatus A in the first condition will be hereinafter discussed. When the object wearing the monitored unit B has travelled a distance greater than a predetermined distance the automatic gain control signal will be less than the signal produced by the preset mechanism 85. Thus, comparator 84 will produce a high output and direct it to the second input of AND gate 76, AND gate 76 will produce an output since the first input is high due to the signal of amplifier 72. Indicator 46 will illuminate informing the operator that the monitored object has exceeded a predetermined distance. Further, the output of AND gate 76 is directed to OR gate 80 which will generate an output to amplifier 82. The output of amplifier 82 will activate alarm 64. Thus, the operator receives both visual and audio alarms. The operator through switch 66 can deactivate audio alarm 64. As previously mentioned, the value of the signal produced by the preset mechanism can be varied, therefore, an attendant can readily vary the range for his/her specific use.

The operator, upon observing the illumination of indicator 46 or the activation of audio alarm 64, will activate reset transmitter 54 which will in turn transmit a signal from the monitoring unit C to the monitored unit B.

The monitored unit B will receive the signal via receiver 6. The reset transmitter signal will be directed to bistable multivibrator 28 and will cause the same to switch from low to high output & vice versa. The high output from bistable multivibrator 28 will result in OR gates 30 and 32 producing a continuous output. Thus, transmitter 4 of monitored unit B will transmit a continuous signal to the monitoring unit C. The continuous signal produced by the monitored unit B will be directed through amplifier 72 to NOT gate 88. The continuous carrier signal 88 causes the output of NOT gate 88 to be low and thus activate timer 90. If the continuous signal is generated for longer than five seconds, the timer 90 will time out and generate a high output to a first input of OR gate 92. The output of OR gate 92 will trigger indicator 94 informing the operator that the monitoring unit is in the search mode. Simultaneously, the output from OR gate 92 is directed through amplifier 96 to search relay 98 thereby energizing the search relay 98. The search relay 98 couples directional antenna 58 to receiver 52. The automatic gain control signal is amplified through inverting amplifier 100. The directional meter 60 readily enables the operator to determine at which orientation the directional antenna provides the highest or strongest output for a given signal. Thus, the operator is readily able to determine the direction in which to proceed to find the object wearing the monitored unit B.

It will be appreciated by one of ordinary skill in the art, that the circuitry could be adapted to provide the operator with an approximation of the distance between the monitored and monitoring units.

The monitored unit is designed to produce an alarm signal when any of the following alert conditions are present. These alert conditions include: manual activation of an alarm by the person being monitored, the monitored unit has been immersed in water, and the monitored unit has been taken off the monitored object. Switch 8 senses whether something has attempted to remove the monitored unit from the monitored object. Pressure switch 10 senses whether the monitored object has been immersed in water and switch 12 is the manual alarm. As explained earlier, upon opening of any of the aforementioned switches, the transmitter 4 of the monitored unit B broadcasts a continuous modulated signal to the monitoring unit C. The modulated signal can be either AM or FM depending upon the user's specific application. Receiver 52 receives the modulated signal and directs it to the input of amplifier 106. The output of amplifier 106 is directed to indicator 50 thereby illuminating the same. This informs the operator that either the monitored object has activated the manual alarm, the monitored unit has been immersed in water, or someone has tried to remove the monitored unit from the monitored object. The output of receiver 52 is simultaneously directed to OR gate 92. The output of OR gate 92 energizes search relay 98 and thereby coupling directional antenna 58 to receiver 52. In this manner, the homing mechanism of the monitoring unit C is automatically energized. Additionally, the receiver 52 is connected to amplifier 108 which in turn triggers audio alarm 64. An operator may deactivate the audio alarm 64 via switch 68.

The frequencies of the signal transmitted by the transmitter 4 of the monitored unit B must differ from the frequency of the signal transmitted by transmitter 54 of monitoring unit C in order for receivers 6 and 52 to receive the appropriate signal. The particular frequencies should be chosen to comply with FCC regulations. The preferable range of the monitoring apparatus A is a quarter of a mile. It would be obvious to one of ordinary skill in the art to vary the transmitters and receivers of monitoring unit C and monitored unit B to increase or decrease the specific range of the units as desired.

The present invention provides a novel apparatus for monitoring persons, pets, things and the like. The present invention is able to significantly reduce the drain on the power source by transmitting a periodic signal as opposed to a continuous signal while threshold conditions are present. However, the present invention is readily adaptable to provide a continuous signal when at least one of a plurality of alarm/alert conditions are present. The continuous signal enables the homing mechanism of the monitoring unit to readily determine the direction needed to travel to locate the monitored object. Further, the monitoring apparatus of the present invention is able to more precisely define the activities of the monitored object which have led to the alarm/alert conditions. This enables the operator to readily reduce the possible areas of search and thus enable the operator to more readily find the monitored object. Finally, the present invention has developed a homing mechanism which is automatically actuated by receipt of either a modulated alarm signal or a continuous carrier signal produced by the monitored object.

While this invention has been described as having a preferred design, it is understood that it is capable of further modifications, uses, and/or adaptions of the invention following in general the principal of the invention and including such departures from the present disclosure as come within the known or customary practice in the art to which the invention pertains such as maybe applied the essential features set forth and fall within the scope of the invention and of the limits of the appended claims.

We claim:

1. An apparatus for monitoring persons, pets, things or the like, comprising:

(a) at least first and second units;

(b) said first unit including signal generating means for producing a plurality of signals;

(c) said plurality of signals including a periodic signal and a continuous signal;

(d) said first unit further including transmitting means operably associated with said signal generating means for transmitting said plurality of signals;

(e) said second unit including a first receiving means for receiving said plurality of signals transmitted by said transmitting means of said first unit;

(f) said second unit further including means operably associated with said first receiving means for comparing at least one of said plurality of signals with at least a first threshold condition;

(g) said periodic signal being transmitted while said at least first threshold condition is met;

(h) said second unit including at least a first indicating means for informing an operator that said at least first threshold condition has been exceeded; and (i) said second unit including means for activating said transmitting means for said first unit, when said first threshold condition is exceeded, for producing said continuous signal.

2. An apparatus as in claim 1, wherein:

(a) said first unit is a monitored unit, and (b) said second unit is a monitoring unit.

3. An apparatus as in claim 1, wherein:

(a) said signal generating means includes a cycle time operably connected to a first input of a first logic gate;

(b) said cycle timer includes means for producing said periodic signal; and (c) said periodic signal is an unmodulated carrier signal.

4. An apparatus as in claim 3, wherein:

(a) said signal generating means further includes a bistable multivibrator operably connected to a second input of said first logic gate;

(b) said bistable multivibrator produces a first low output and a second high output;

(c) said first low output is continuous and produced while the threshold condition is met; and (d) said second high output is produced when said threshold condition is exceeded.

5. An apparatus as in claim 4, wherein:

(a) said first logic gate is an OR gate;

(b) said OR gate has a continuous output when said bistable multivibrator produces said second high output; and (c) said OR gate has a periodic output when said bistable multivibrator produces said first low output.

6. An apparatus as in claim 1, wherein:

(a) said signal generating means includes switch means;

(b) said switch means being operably connected to at least a first logic gate;

(c) said first logic gate is a NOT gate;

(d) said switch means is operably connected to the input of said NOT gate; and (e) said NOT gate produces a high output when said switch is in an open position.

7. An apparatus as in claim 6, wherein:

(a) said output of said NOT gate is operably connected to a first input of a second logic gate.

(b) said second logic gate is an OR gate;

(c) means operably associated with a second input of said OR gate for maintaining a continuous output from said OR gate although said switch means has been closed after opening thereof.

8. An apparatus for monitoring persons, pets, things or the like, comprising:

(a) at least a first monitored unit;

(b) a monitoring unit for monitoring said at least first monitored unit for determining whether at least one of a plurality of alert conditions is present;

(c) said at least first monitored unit including transmitting means for transmitting a plurality of signals;

(d) said monitoring unit including a receiving means for receiving said plurality of signals;

(e) said plurality of alert conditions including a first condition wherein said monitored unit has exceeded a predetermined distance from said monitoring unit, a second condition wherein said monitoring unit is not receiving a signal from at least one of said monitored units, and a third alarm condition wherein an alarm is activated;

(f) said monitoring unit further including means for analyzing said plurality of signals for determining whether at least one of said plurality of alert conditions is present;

(g) said monitoring unit including means for indicating to an operator that at least one of said plurality of said alert conditions is present; and (h) said indicating means including means for readily informing the operator precisely which alert condition has been activated.

9. An apparatus as in claim 8, wherein:

(a) said plurality of signals include a periodic signal, a continuous signal and an alarm signal;

(b) said analyzing means includes a first timing means;

(c) said indicating means includes a first indicating member; and (d) said timing means is operably associated with said first indicating member for informing the operator that said monitoring unit has not received said periodic signal for a predetermined time from said at least first monitored unit.

10. An apparatus as in claim 9, wherein:

(a) said analyzing means includes at least a first comparator;

(b) means operably associated with a first input of said first comparator for establishing a threshold condition;

(c) said receiving means is operably associated with a second input of said first comparator for inputting an automatic gain control signal thereto;

(d) said indicating means includes a second indicating member operably associated with an output of said first comparator for informing the operator that said automatic gain control signal has fallen below said threshold condition and thus said monitored unit has travelled beyond a predetermined distance.

11. An apparatus as in claim 10, wherein:

(a) said threshold condition means includes means for varying said threshold condition.

12. An apparatus as in claim 9, wherein:

(a) said analyzing means includes a second timing means;

(b) said second timing means is operable to determine whether said receiving means has received said continuous signal for a predetermined time;

(c) homing means operably associated with said second timing means for determining the location of said monitored unit; and (d) means for activating said homing means when said second timer receives said continuous signal for a predetermined period of time.

13. An apparatus as in claim 12, wherein:

(a) said indicating means includes a third indicating member for informing the operator that said monitoring unit is in a search mode when said second timing means has received a continuous signal for a predetermined period of time.

14. An apparatus as in claim 13, wherein:

(a) said indicating means includes a fourth indicating member;

(b) said fourth indicating member being operably associated with said receiving means for informing the operator upon receipt of said alarm signal.

15. An apparatus for monitoring persons, pets, things or the like, comprising:

(a) at least a first monitored unit;

(b) a monitoring unit for monitoring said at least first monitored unit for determining whether at least one of a plurality of alert conditions is present;

(c) said first monitored unit including a first transmitting means for transmitting at least first and second signals;

(d) said monitoring unit including a first receiving means for receiving said at least first and second signals;

(e) said monitoring unit further including means for analyzing said at least first and second signals for determining whether at least a first alert condition or a threshold condition is present;

(f) said first signal being transmitted when said threshold condition is present;

(g) said second signal being transmitted when said at least first alert condition is present;

(h) said at least first alert condition including a condition wherein said monitored unit has exceeded a predetermined distance;

(i) said monitoring unit including homing means for determining the location of said monitored unit;

(j) said monitoring unit including means for differentiating between said first and second signals, said differentiating means being operably associated with said homing means; and (k) said monitoring unit including activating means for automatically energizing said homing means upon receipt of said second signal by said receiving means.

16. An apparatus as in claim 15, wherein:

(a) said monitoring unit includes a second transmitting means;

(b) said monitoring unit includes a second receiving means;

(c) said second transmitting means is operable to transmit a reset signal when said at least first alert condition is present; and (d) said monitored unit includes means operably associated with said second receiving means whereby upon receipt of said reset signal said monitored unit transmits said second signal.

17. An apparatus as in claim 16, wherein:

(a) said first alert condition is present when said monitored unit has exceeded a predetermined distance between said monitoring and said monitored units.

18. An apparatus as in claim 15, wherein:

(a) said monitoring unit includes means for indicating to an operator that said homing means has been energized.

* * * * *